US006579009B1

(12) United States Patent
Schinasi

(10) Patent No.: US 6,579,009 B1
(45) Date of Patent: Jun. 17, 2003

(54) CONTAINER LINER

(75) Inventor: Piero Schinasi, Epalinges (CH)

(73) Assignee: Codefine SA, Lausanne (CH)

( * ) Notice: Subject to any disclaimer, the term of this patent is extended or adjusted under 35 U.S.C. 154(b) by 0 days.

(21) Appl. No.: 10/019,152

(22) PCT Filed: Feb. 14, 2000

(86) PCT No.: PCT/CH00/00084

§ 371 (c)(1),
(2), (4) Date: Oct. 22, 2001

(87) PCT Pub. No.: WO00/71441

PCT Pub. Date: Nov. 30, 2000

(30) Foreign Application Priority Data

May 19, 1999 (CH) ..... 936/99

(51) Int. Cl.[7] ..... B65D 33/02
(52) U.S. Cl. ..... 383/119; 220/1.6
(58) Field of Search ..... 383/105, 119, 383/903; 220/1.6

(56) References Cited

U.S. PATENT DOCUMENTS 3,949,901 A 4/1976 Takita
3,980,196 A * 9/1976 Paulyson et al. ..... 220/1.6
4,054,226 A * 10/1977 Bjelland et al. ..... 220/1.6
5,137,170 A * 8/1992 Matias ..... 220/1.5
5,222,621 A * 6/1993 Marias ..... 220/1.6
5,328,268 A * 7/1994 Lafleur ..... 220/652
5,421,476 A * 6/1995 Matias ..... 220/1.6
5,564,833 A * 10/1996 Proffitt ..... 383/105
5,649,767 A * 7/1997 Nickell et al. ..... 383/105
5,657,896 A * 8/1997 Matias ..... 220/1.6
5,685,644 A * 11/1997 Taylor ..... 383/105
5,785,175 A * 7/1998 Cholsaipant ..... 206/386
5,873,655 A * 2/1999 Echeverria ..... 383/105
6,220,755 B1 * 4/2001 Brown et al. ..... 383/109
6,402,378 B1 * 6/2002 Shackleton ..... 383/119
6,415,927 B1 * 7/2002 Stone et al. ..... 383/119

FOREIGN PATENT DOCUMENTS

EP 0280493 A 8/1988

* cited by examiner

*Primary Examiner*—Jes F. Pascua
(74) *Attorney, Agent, or Firm*—Clifford W. Browning; Woodard, Emhardt, Moriarty, McNett & Henry LLP

(57) ABSTRACT

The invention concerns a liner comprising six faces, one of which corresponds to the container door. At least one fabric strip is stitched only over part of the face corresponding to the door and only over part on the inside of two adjacent vertical faces. On the other hand, the intermediate section of the strip are stitch-free and form reserves leaving free the vertical ridges constituting the joint between said adjacent faces and said face corresponding to the door.

7 Claims, 3 Drawing Sheets

CONTAINER LINER

Figure 1:
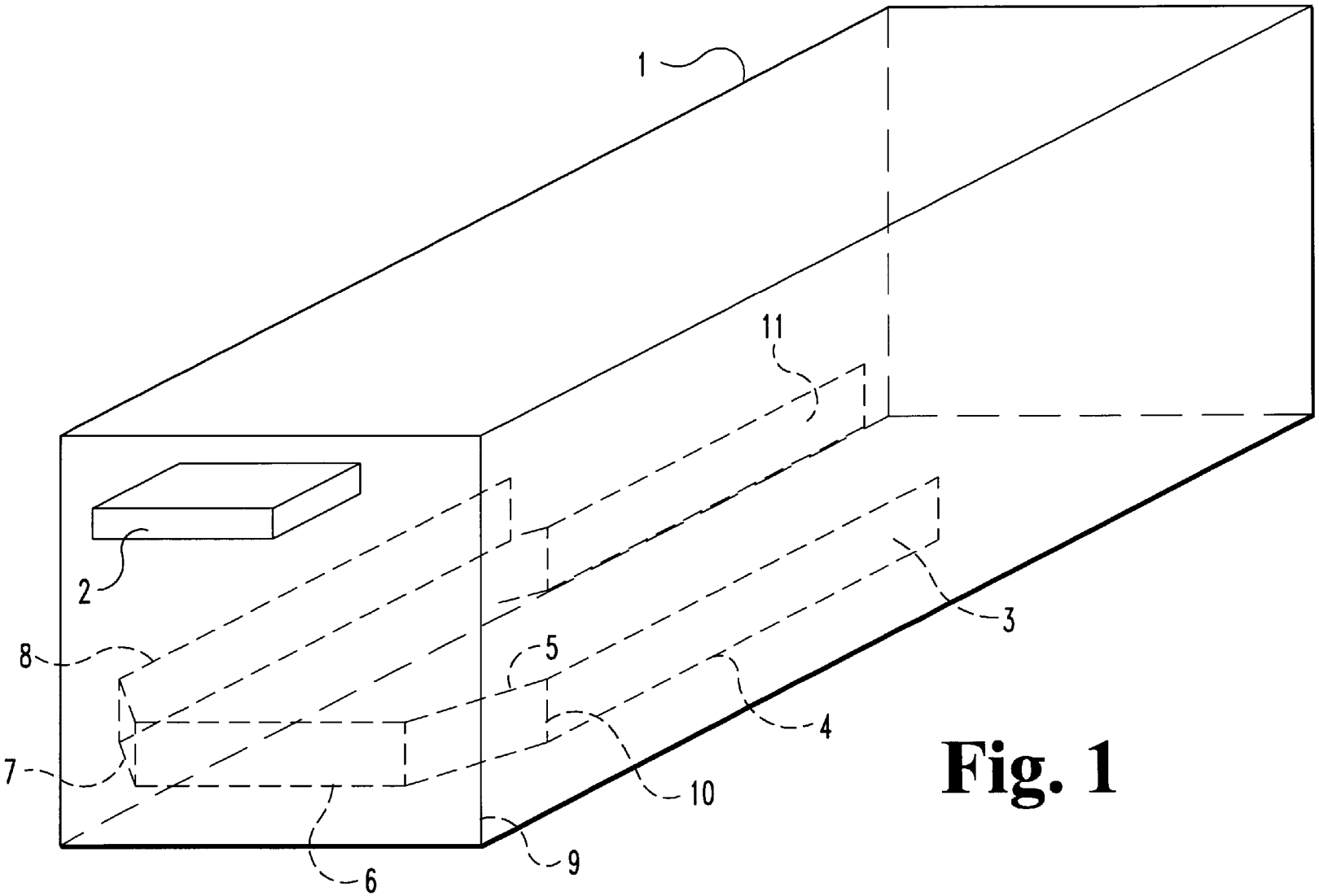

The present invention relates to an internal envelope (liner) for a container.

In the goods transportation industry, in particular for bulk goods, use is commonly made of containers for transporting the most varied goods. This relates particularly to maritime transportation and the containers, notably the 20 foot ones, form part of the normal landscape of port areas.

According to the goods to be transported, it has been the usual custom, since the middle of the 1970s, to line the inside of the container with a liner so as to prevent the goods from being in contact with the internal wall of the container. These liners are in the form of large bags, in the shape overall of a right-angled parallelepiped, that is to say that of the container. These liners are provided with filling openings, emptying spouts and other devices intended to allow or facilitate the introduction and the emptying of the goods. In addition, these liners are made from synthetic fabric, polypropylene, polyethylene or other.

One problem encountered during the use of such bags is due to the face of the bag which corresponds to the door (in general with two leaves) of the container. This is because, during filling, this face naturally has a tendency to curve outwards, to bulge. As a result the door of the container cannot be closed or cannot be closed properly.

In order to attempt to eliminate this drawback, use has been made of metallic bars disposed, like a showjumping obstacle, across the door and bearing in the walls of the container. This solution is not satisfactory because of the excessive handling required and the problems of transportation, storage and standardisation of the bars.

Another proposal consists in equipping the liner with a number of straps anchored at different points on the liner and container, the retaining function being essentially exerted by straps placed inside the deployed volume of the liner; one example of this is given in the document EP 0528533. Here too the handling and fitting are not easy.

The purpose of the present invention is to propose an internal envelope for a container, that is to say a liner, which makes it possible to usefully neutralise the natural tendency towards bulging of the face of the liner corresponding to the door of the container, by means of the constructional characteristics of the liner, that is to say elements present from the time the liner is made, which require no handling or fitting when the liner is installed in the container, at the time of filling or emptying.

For this purpose, the invention relates to an internal envelope for a container, that is to say a liner, having six faces, one of which corresponds to the door of the container, and in which at least one strip of fabric is sewn onto only part of the inside of the face corresponding to the door and onto only part of the interior of the two adjacent vertical faces, the intermediate portions of the strip being free of stitching and forming recesses which leave partially free the vertical edges marking the join between the said adjacent faces and the said face corresponding to the door.

According to one embodiment, several parallel strips are applied.

The strip of fabric can be sewn so that it is horizontal. It can be produced with a tubular fabric.

Figure 2:
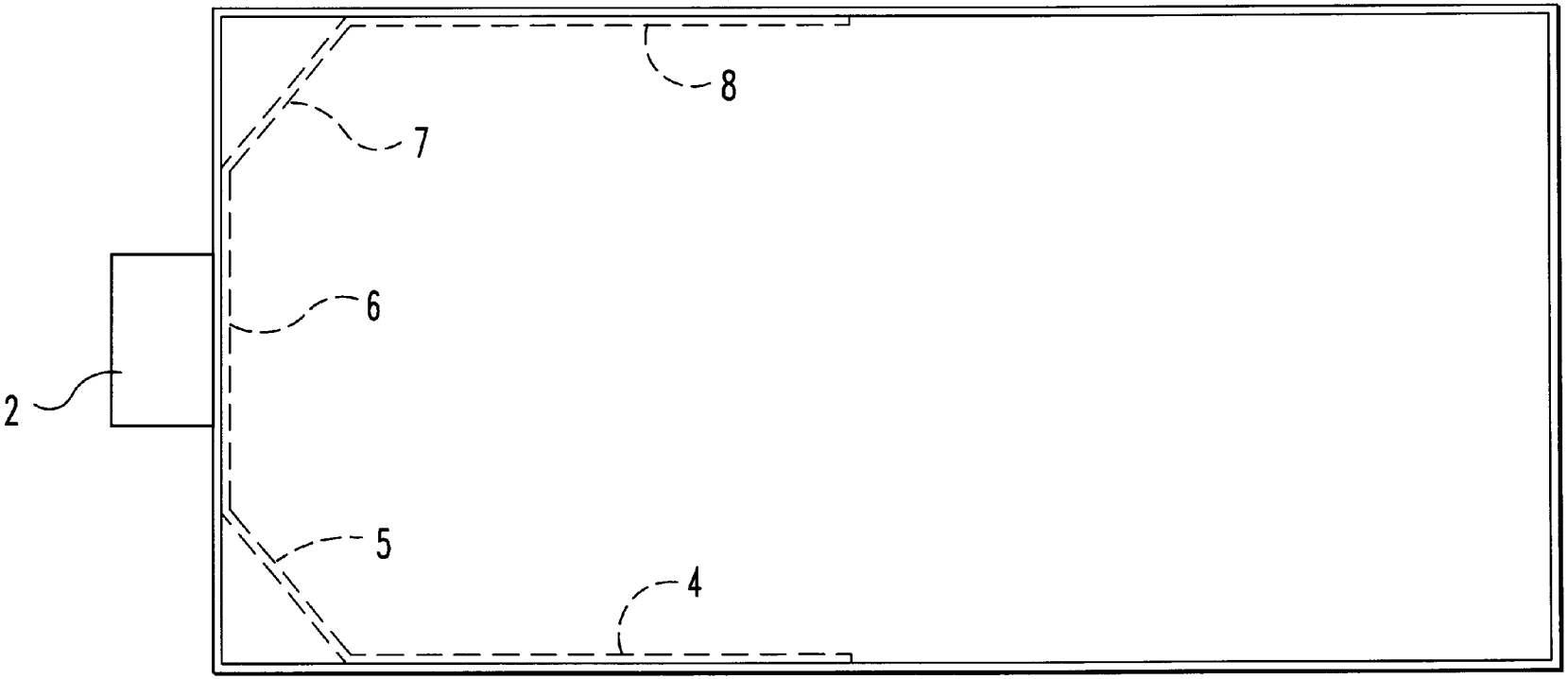
Figure 3:
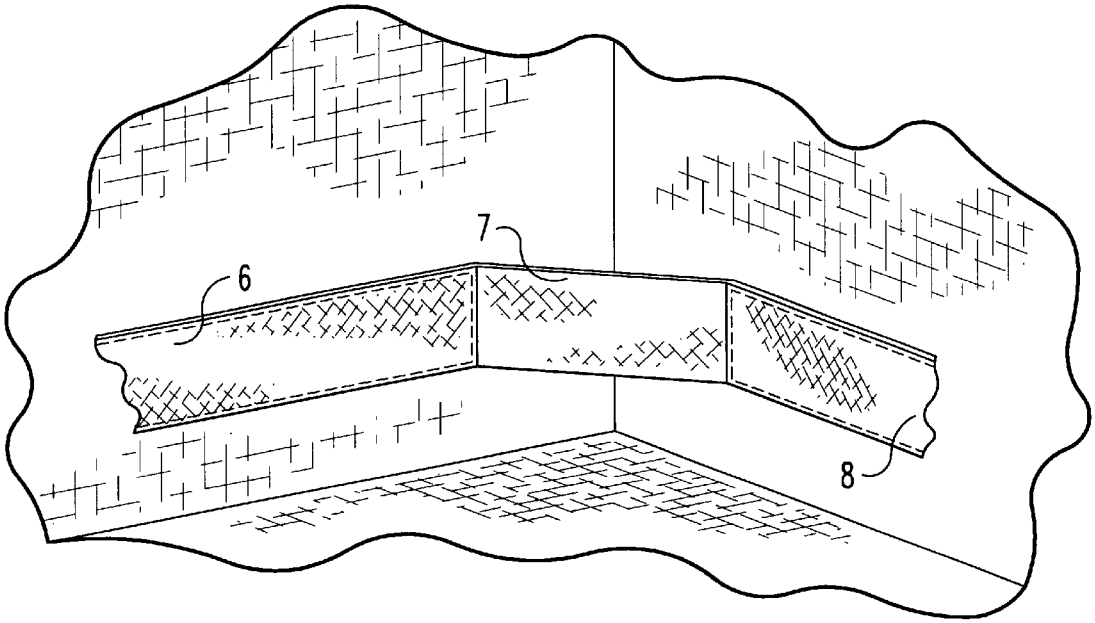

The following description is based on the drawing, in which:

FIG. 1 gives a perspective view of the liner according to the invention, the various faces being depicted ideally pressed against the walls of the container, FIG. 2 gives a plan view of the liner according to the invention, FIG. 3 gives a view of a detail of the interior of the liner according to the invention, more precisely at the vertical joining edge between the face of the liner corresponding to the door of the container and one of the longitudinal faces of the liner.

With regard to FIG. 1, the liner 1 can be seen, provided with a filling opening 2, situated in the face of the liner corresponding to the door of the container. It can also be seen that a strip of fabric 3 is sewn inside the liner. This strip of fabric can be produced for example with a tubular fabric issuing from a circular loom.

This strip of fabric 3 is sewn horizontally, so that its edges are parallel to the non-vertical edges of the liner and consequently of the container. The strip of fabric 3 is thus sewn with regard to a first portion 4 on at least part of a first lateral (longitudinal) face of the liner. However, the stitching does not go as far as the edge 9 marking the join between the faces of the liner. On the contrary, stopping the stitching leaves the strip of fabric free on a second portion 5, where a vertical stitching 10 may if necessary mark the limit. On a third portion 6, the strip of fabric is sewn on the face of the liner corresponding to the door of the container. The following portion 7 is the counterpart of the portion 5 and the final portion 8 constitutes the replica of the initial portion 4.

It can also be seen that at least one second strip of fabric 11, which is sketched only partially on the drawing in order not to overload the figure, can be provided; it is in all respects identical to the first.

The number, the width and the exact location of the various strips of fabric will be chosen according to the size of the container and according to the particular properties of the goods to be transported.

In FIG. 2, the same elements are found as in FIG. 1 and in particular the five portions 4, 5, 6, 7 and 8 of the strip of fabric. It is stated here, if needs be, that these are functional portions rather than distinct pieces.

FIG. 2 shows that the portions 5 and 7 of the strip of fabric form an angle both with the lateral faces of the liner and with the face corresponding to the door in which the filling opening 2 opens out.

Pressure exerted on the portions 5 and 7 by the goods, from inside the liner towards the outside, results in a traction effect, towards the inside, on the middle portion 6, preventing or usefully decreasing the bulging which it was precisely sought to combat.

In FIG. 3, there are three portions 6, 7 and 8 of the strip of fabric. This view makes it possible to detail what happens inside the liner during filling.

For a first step, the merchandise, which has fluid properties, coffee for example, commences with spreading freely in the liner, pressing the bottom of the vertical faces thereof against the walls of the container. In a second step the merchandise arrives at the bottom of the first strip of fabric and begins to press against the portion 7 of the strip, which imparts a shrinkage movement on the middle portion 6. However, as soon as the merchandise reaches the top of the strip, the gap left free in the corner is filled in, consolidating and as it were stratifying the non-curved position of the face of the liner corresponding to the door.

The process is obviously repeated over the entire loading height as many times as there are strips of fabric arranged inside the liner.

The advantages of the liner according to the invention are to make it possible to combat the bulging effect solely by means applied to the liner at the time of its manufacture and using only elements belonging to the technology of manufacturing these envelopes, that it to say fabric, strips of fabric and stitching.

In other words, when a carrier receives such a liner from the manufacturer everything is already present. The liner merely has to be installed in the container and filled, that is all. Compared with the handicap of handling, weight and price represented by the known solutions up till now, metallic bars or strap harness, the liner according to the invention has significant advantages in all regards.

What is claimed is:

1. A liner for a rigid rectangular container said container having six faces, namely, one horizontal top face, one horizontal bottom face, two vertical side faces, one vertical rear face and one vertical front face being the door of the container, said liner being rectangular and having six faces corresponding to the six faces of the container, one of the said liner faces corresponding to the said door face of the container, wherein at least one strip of fabric is sewn onto only part of the inside of the liner face corresponding to the door face of the container and onto only part of the interior of the liner faces corresponding to the said two vertical side faces of the container so as to leave two intermediate portions of the strip free of stitching, said intermediate portions forming recesses which leave partially free the two vertical edges marking the join between the said liner face corresponding to the door face of the container and the two liner faces corresponding to the vertical side faces of the container; the length of the part of the strip sewn onto the liner face corresponding to the door face of the container being shorter than the length of the parts of the strip that are sewn onto the two liner faces corresponding to the vertical side faces of the container.

2. A liner according to claim 1, wherein several parallel strips are applied one above the other and are positioned so as to leave a room between them and so as to exclude any overlap of the strips.

3. A liner according to claim 2, herein the strips of fabric is sewn so that they are horizontal.

4. A liner according to claim 2, wherein the strips of fabric are produced with a tubular fabric.

5. A liner according to claim 1, wherein the strip of fabric is sewn so that it is horizontal.

6. A liner according to claim 5, wherein the strip of fabric is produced with a tubular fabric.

7. A liner according to claim 1, wherein the strip of fabric is produced with a tubular fabric.

* * * * *

UNITED STATES PATENT AND TRADEMARK OFFICE

CERTIFICATE OF CORRECTION

PATENT NO. : 6,579,009 B1
DATED : June 17, 2003
INVENTOR(S) : Piero Schinasi

It is certified that error appears in the above-identified patent and that said Letters Patent is hereby corrected as shown below:

Title page,
Item [57], ABSTRACT,
Line 3, please insert -- of the inside -- between "over part" and "of the face."
Line 5, please delete "section" and insert in lieu thereof -- sections --.

Column 4,
Line 12, please delete "herein" and insert in lieu thereof -- wherein --.

Signed and Sealed this

Twenty-eighth Day of October, 2003

JAMES E. ROGAN
*Director of the United States Patent and Trademark Office*